US005117253A

United States Patent [19]

Suzuki

[11] Patent Number: 5,117,253

[45] Date of Patent: May 26, 1992

[54] COLOR SEPARATING DEVICE IN COLOR COPYING MACHINE

[75] Inventor: Minoru Suzuki, Tokyo, Japan

[73] Assignee: Asahi Kogaku Kogyo Kabushiki Kaisha, Tokyo, Japan

[21] Appl. No.: 197,974

[22] Filed: May 24, 1988

[30] Foreign Application Priority Data

May 30, 1987 [JP] Japan ..... 62-136713

[51] Int. Cl.[5] ..... G03B 27/32; G03B 27/52

[52] U.S. Cl. ..... 355/32; 355/35; 355/38

[58] Field of Search ..... 355/32, 35, 38

[56] References Cited

U.S. PATENT DOCUMENTS

| | | | |
|---|---|---|---|
| 3,002,425 | 10/1961 | Biedermann et al. | 355/38 |
| 3,229,569 | 1/1966 | Frost et al. | 355/38 |
| 3,892,482 | 7/1975 | Weisglass | 355/35 |
| 4,746,955 | 5/1988 | Slayton et al. | 355/35 |

FOREIGN PATENT DOCUMENTS

| | | |
|---|---|---|
| 55-30232 | 8/1980 | Japan . |
| 60-257441 | 12/1985 | Japan . |
| 62-265643 | 11/1987 | Japan . |

*Primary Examiner*—Monroe H. Hayes

*Attorney, Agent, or Firm*—Sandler, Greenblum & Bernstein

[57] ABSTRACT

A color separating device in a color copier includes a predetermined number of filter frames which carry different color filters corresponding to the colors to be separated and which can be moved between a retracted position in which the color filters are retracted from an optical path of an imaging optical system of the copier and an operative position in which the color filters are located in the optical path, the direction of movement being perpendicular to the optical path, guides for guiding the movement of the filter frames, springs for continuously biasing the filter frames toward the retracted position, an endless belt which can be selectively engaged by the filter frames to move the filter frames, and a motor for intermittently rotating the endless belt. The endless belt has driving projections and the filter frames have associated abutments which can be selectively engaged by the driving projections to successively bring the color filters into an operative position against the springs during one rotation of the endless belt.

31 Claims, 8 Drawing Sheets

COLOR SEPARATING DEVICE IN COLOR COPYING MACHINE

BACKGROUND OF THE INVENTION

1. Field of the Invention

The present invention relates to a color copying machine and more precisely relates to a color separating device forming part of the copying machine.

2. Description of Related Art

In a conventional color copier, image data of an object are separated into three colors of R (Red, 620 nm), G (Green, 525 nm), and B (Blue, 450 nm) to successively form latent images on a photoconductive drum. These latent images are developed with yellow, magenta, and cyanine and are superimposed to produce a color copy.

FIG. 8 shows a copying system of a known color copier. In FIG. 8, a scanning unit S having therein an illuminating light source 12 and scanning mirrors 13 and 14 is provided below a transparent glass plate 11 on which an object (document) 0 is located. The scanning unit S having the illuminating light source 12 and the scanning mirrors 13, 14 incorporated therein is scanned from a position shown by a solid line S to a position shown by an imaginary line S'(12', 13' 14'). The light which is emitted from the light source 12 (12') is reflected by the document 0 and then by the mirrors 13 and 14 and is transmitted onto a photoconductive drum 17 through a wavelength selecting filter (color separating mechanism) 15, an imaging optical system 16, and immovable mirrors $M_1$, $M_2$, $M_3$. On the circumference of the photoconductive drum 17 are provided various known color copying elements, such as a charger 18, a developing unit assembly 19 having developing units (19*a* for yellow, 19*b* for magenta, 19*c* for cyanine and 19*d* for black) corresponding to the respective selected wavelengths, and a transfer unit 20, etc. In FIG. 8, 21 designates a paper on which the image is to be copied, and 22 a paper feeder therefor.

In the known arrangement as shown in FIG. 8, the color separating mechanism 15 which is located in front of the imaging optical system 16 successively inserts color filters of the three colors (R, G and B) in the optical path of the imaging optical system to effect the color separation. Alternatively, it is also known to arrange, between the light source 12 and the document 0, a color separating mechanism in which the color filters R, G and B are selectively inserted into the optical path to carry out color separation. When the scanning unit S is scanned for respective colors, image data (i.e. of the latent image) which are separated into three colors R, G and B are formed on the photoconductive drum 17.

In the developing unit assembly 19, the developing unit (yellow) 19*a* is used for the latent image which is formed by the color filter B, the developing unit 19*b* (magenta) for the latent image which is formed by the color filter G, and the developing unit 19*c* (cyanine) for the latent image which is formed by the color filter R. The latent images developed on the photoconductive drum 17 are superimposed on the same paper 21 to obtain a desired color copy.

In the color separating mechanism 15, there is a need for quickly and certainly changing the three or four) color filters G, B and R (and M for monochrome, if necessary) within a small space.

For instance, Japanese Examined Patent Publication (Kokoku) No. 55-30232 disclosed a concentric arrangement of color filters which radially extend about a rotational shaft, so that when the rotational shaft rotates, the color filters are selectively introduced into the optical path. However, the arrangement disclosed in this publication needs a relatively large space for accommodating the rotational movement of the color filters.

SUMMARY OF THE INVENTION

The primary object of the present invention is to provide a compact and simple color separating device which can quickly change color filters within a limited small space.

To achieve the object of the invention mentioned above, according to the basic concept of the invention, the color filters are selectively brought into the optical path of the imaging optical system by linear displacement via the use of an endless belt.

According to an aspect of the present invention, there is provided a color copying machine having a light source for illuminating an object, an imaging optical system for projecting an image of the illuminated object, a photoconductive body for receiving the image of the object formed by the imaging optical system, and a color separating device for separating the image of the illuminated object into a predetermined number of colors to transfer the colors onto the photoconductive body, characterized in that said color separating device comprises a plurality of color filters corresponding to the colors to be separated said color filters being capable of linear movement between a retracted position in which the color filters are retracted from an optical path of the imaging optical system and an operative position in which the color filters are located in the optical path, said movement being in a direction perpendicular to the optical path, means for guiding the linear movement of the color filters, means for continuously biasing the color filters toward the retracted position, an endless belt which can be selectively engaged by the color filters to carry out the linear movement of the color filters, means for intermittently rotating the endless belt, and means for establishing the selective engagement of the color filters with the endless belt to successively bring the color filters into the operative position against the biasing means during one rotation of the endless belt.

Preferably, the color filters are carried by filter frames which are located parallel to each other.

The guiding means can be composed of upper and lower guide rails and side partition walls between the guide rails to separate the color filters from one another, so that the color filters can be moved on and along the upper and lower guide rails between the adjacent side partition walls.

Alternatively, the guiding means can be comprised of guide rods which extend through the filter frames, so that the color filters can slide on and along respective guide rods.

The biasing means, preferably, have spiral springs which are connected to the associated color filters, so that movement of the color filters can be performed within a small space. Preferably, the spiral springs are wound around respective pulleys which are rotatably supported by a frame body of the color separating device.

Preferably, the means for establishing selective engagement between the color filters and the endless belt has projections which are provided on the endless belt and which are spaced from one another so as to correspond to the respective color filters, and abutments which are provided on the filter frames and which are selectively engaged by the associated projections of the endless belt in accordance with the rotation of the endless belt. The projections of the endless belt are placed so that when one of the projections of an endless belt is disengaged from the associated abutment on the filter frames, another projection of the endless belt can be engaged by an associated abutment of another filter frame.

BRIEF DESCRIPTION OF THE DRAWINGS

The invention will be described below in detail with reference to the accompanying drawings, in which.

DETAILED DESCRIPTION OF EMBODIMENTS

Figure 1:
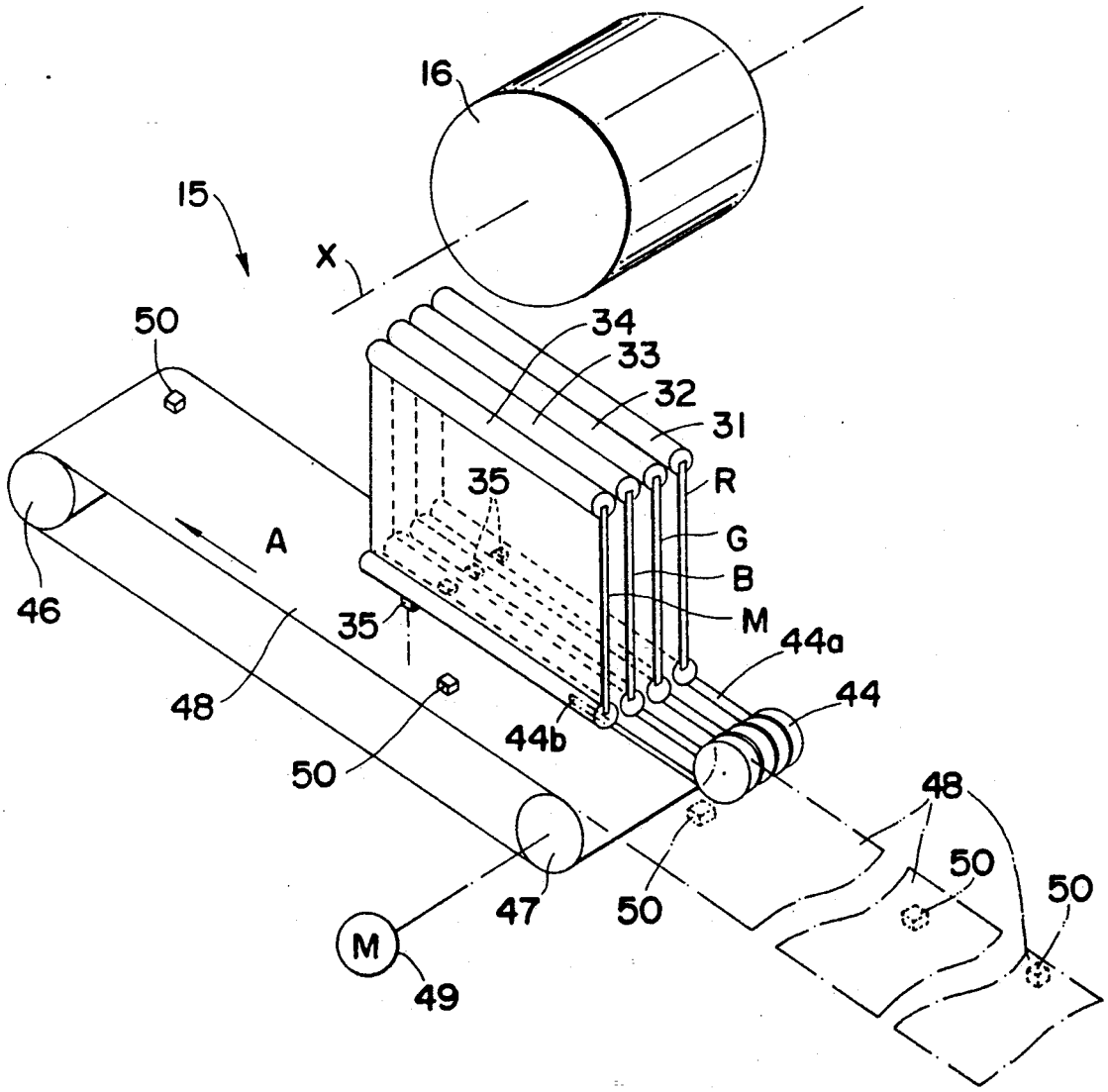
FIG. 1 is a perspective view of a main part of a color separating device in a color copier, according to one embodiment of the present invention.
Figure 2:
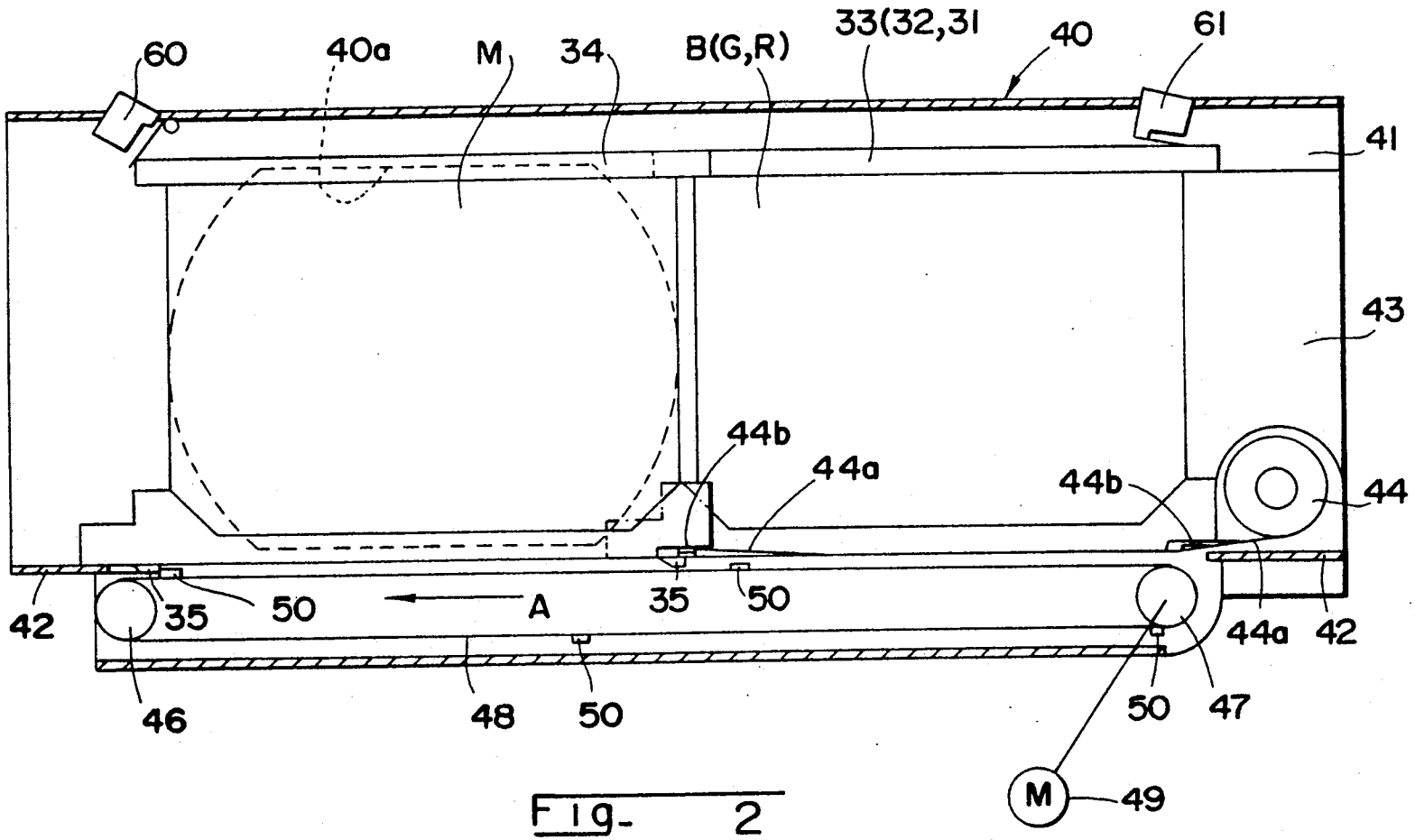
FIG. 2 is a front elevational view of FIG. 1.
Figure 3:
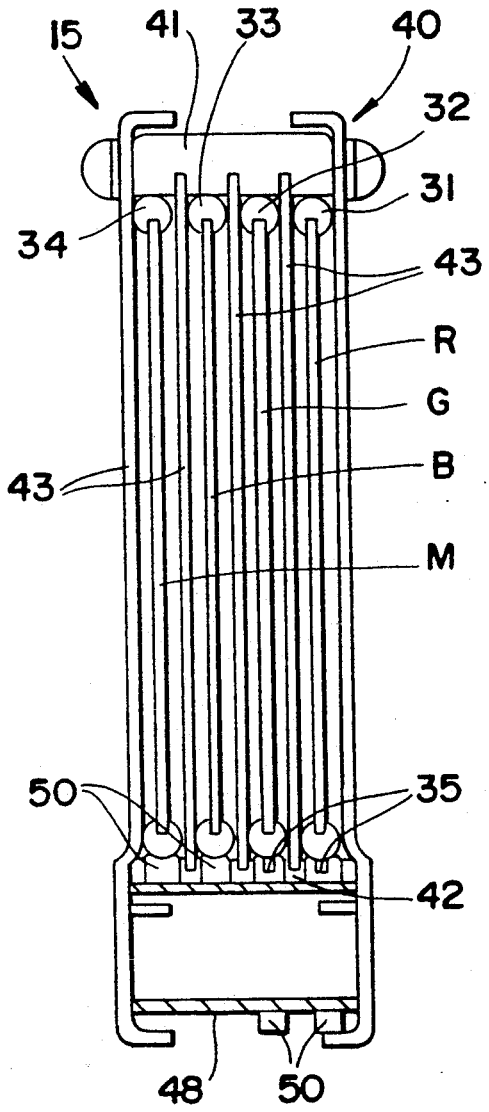
FIG. 3 is a side elevational view of FIG. 1.
Figure 5:
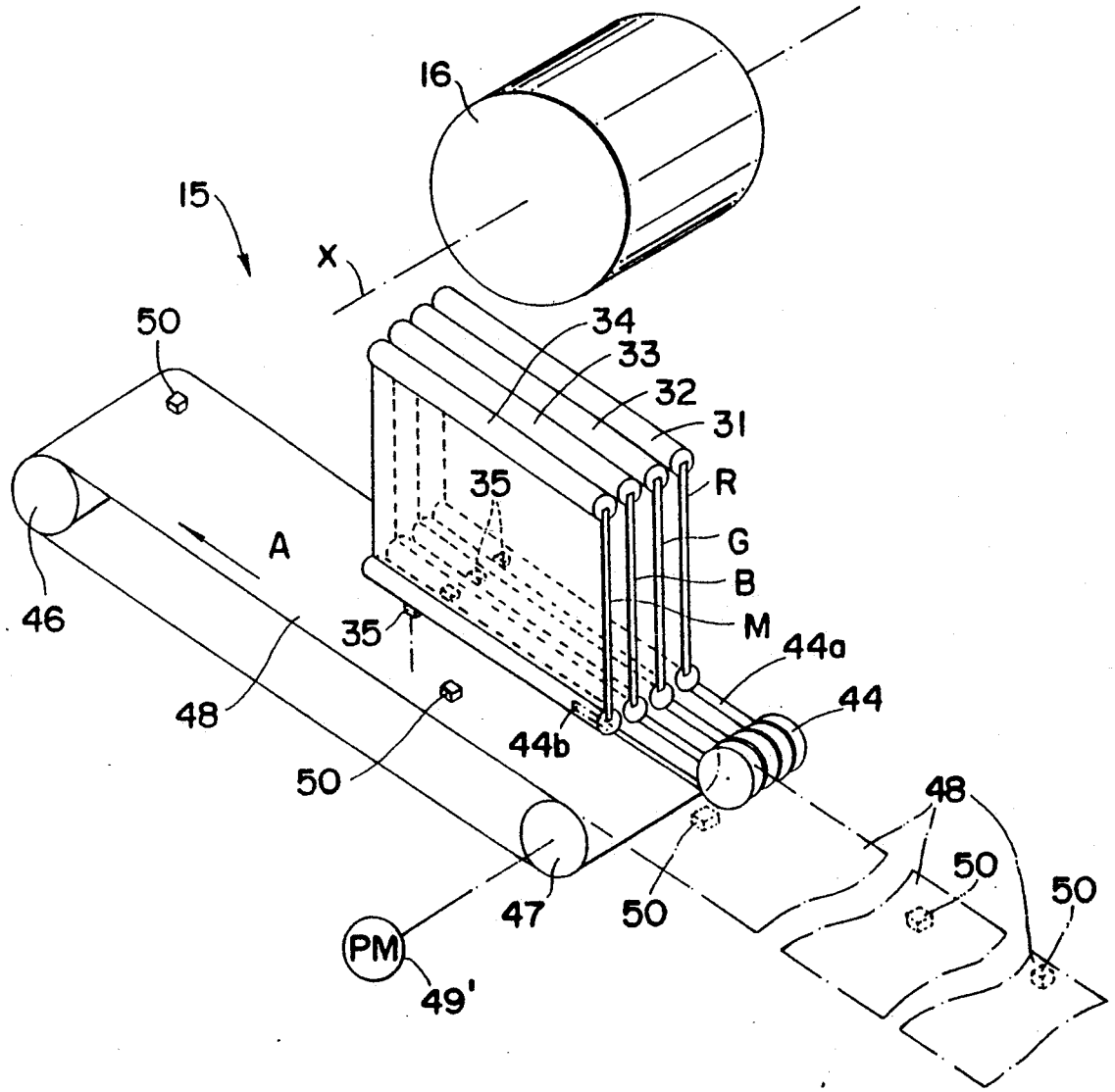
FIG. 5 is a view similar to FIG. 1, but showing another embodiment of the present invention.

The color filters R, G, B and M are held by the respective filter frames 31, 32, 33 and 34 in parallel with each other, as shown in FIGS. 1 to 3. The filter frames 31-34 are supported by the upper and lower guide rails 41 and 42 of the frame body 40 and the side partition walls 43 between the upper and lower guide rails, of the color separating device 15, so that the filter frames can independently move in a linear direction along the guide rails 41 and 42 in order to selectively insert the color filters into the optical path (optical axis X) of the imaging optical system 16 (FIG. 5). Namely, the filter frames can be moved between a retracted position in which they are retracted from the optical path and an operative position in which the filter frames are located in the optical path, in a direction perpendicular to the optical path. The frame body 40 has a small opening 40*a* smaller than the color filters R, G, B and M, corresponding to the optical axis X, as shown in FIG. 2.

The frame body 40 has rotatable pulleys 44 corresponding to filter frames 31-34. The pulleys 44 are rotatably supported by the frame body of the device. The pulleys 44 are located on the side of the frame body 40 far from the optical axis X and have spiral springs 44*a* wound thereon and secured thereto, so that the front ends of the spiral springs 44*a* are secured to the lower ends of the filter frames 31-34, by means of pins 44*b*, respectively. The spiral springs 44*a* are biased in the winding direction, so that the filter frames 31-34 are continuously biased toward the retracted position to move away from the optical axis X.

The filter frames 31-34 are provided on their lower ends, with abutments 35, as can be seen from FIG. 1. The frame body 40 is provided, on its opposite ends in the lengthwise direction of the guide rails 42, with rollers (sprockets) 46 and 47 below the guide rails 42. An endless belt 48 is wound around the rollers 46 and 47 so as to rotate without slipping. One of the rollers 46 and 47 is connected to a drive 49, such as a motor, so that the endless belt 48 is rotated by the drive 49 at a predetermined timing.

The endless belt 48 has four driving projections 50 corresponding to the abutments 35 of the filter frames 31-34, so that when the driving projections 50 come into contact with the abutments 35, the movement of the endless belt 48 in the direction A causes the filter frames to move in the direction A, i.e., towards the operative position, against the spiral springs 44*a*.

The four driving projections 50 are laterally spaced from one another on the endless belt 48 to correspond to the respective abutments 35 of the filter frames 31-34. Also, the driving projections 50 are spaced from one another in the direction of the movement of the endless belt 48, so that only one projection 50 comes into contact with a corresponding abutment 35 at one time. Namely, only one of the filter frames 31-34, and accordingly only one of the color filters R, G, B and M can be brought in the optical path of the imaging optical system 16 at one time. In other words, more than two filter frames can not be simultaneously inserted in the optical path.

In the illustrated arrangement, the projections 50 and the abutments 35 are placed in such a way that when one of the projections 50 of the endless belt is disengaged from an associated abutment 35, another projection 50 is engaged by the associated abutment 35 of another filter frame.

The drive 49 for the rotational movement drives the endless belt 48 so that the four driving projections 50 successively come directly above the roller 46. When the driving projections 50 come above the roller 46, that is, when the color filters are successively inserted in the optical path of the imaging optical system 16, the endless belt 48 stops moving. When the color separation by the color filters is completed, the endless belt 48 begins moving again.

With the color separation mechanism 15 mentioned above, the intermittent rotation of the endless belt 48, at a predetermined timing in the same direction effected by the drive 49, causes the color filters R, G, B and M to come into the optical path of the imaging optical system 16 in a desired order. Namely, assuming that the color filters R, G, B and M are located in this order, as shown in FIG. 1 and that the driving projections 50 secured on the endless belt 48 are spaced in the lengthwise direction of the endless belt, as shown in the developed view shown by the imaginary line of FIG. 1, the leftmost driving projection first brings the filter frame 34 of M into the optical path of the imaging optical system 16 at a specific rotational position of the endless belt 48. When that driving projection 50 comes above the roller 46, the endless belt 48 stops moving. During stoppage of the endless belt, the scanning of the document 0 and the formation of a latent image on the photoconductive drum 17 are effected. When these successive operations are completed, the endless belt 48 is rotated again by the drive 49, so that the driving projection which has been engaged with the associated abutment 35 of the color filter M moves and comes below the roller 46. As a result, the color filter M (filter frame 34) is quickly retracted from the optical path and is returned to its initial position (retracted position) by the associated spiral spring 44*a*. In FIG. 2, the color filter M is located in the optical path and the other color filters are retracted from the optical path.

The second driving projection 50 from the left in FIG. 1 comes into engagement with the associated projections 35 of the color filter B when the color filter M is retracted from the optical path, so that the operations mentioned above are repeated. By one rotation of the endless belt 48, color separation by the color filters M, B, G and R is completed. The latent images are successively formed on the photoconductive drum 17 for respective color filters. The latent images are developed onto the same recording object (paper). After the developed image is fixed, the paper is discharged.

The insertion of the color filters into the optical path is effected in synchronization with the scanning of the document and the development, the transfer of the latent image, etc. by a detector which detects the insertion of the first color filter into the optical path. The detector can be composed of, for example, an insertion detecting microswitch 60 which is actuated by one of the filter frames 31–34, for example the filter frame 34 (FIG. 5), which comes into the optical path X of the imaging optical system 16, and a retraction detecting microswitch 61 which is actuated by one of the filter frames 31–34, for example the last filter frame 31 which is retracted from the optical path X of the imaging optical system 16.

It is also possible to provide a plurality of insertion detecting microswitches 60 and a plurality of retraction detecting microswitches 61 corresponding to the filter frames 31–34.

As a drive for the intermittent rotation of the endless belt 48 can be used a pulse motor which can control the positions of the color filters by counting the number of pulses, as shown in FIG. 5. Namely, supposing that when the pulse motor 49' (PM) rotates by N pulses, the endless belt 48 moves by a predetermined displacement in which one color filter is moved from the retracted position to the operative position in which the color filter is located in the optical path, and the intermittent rotation of the pulse motor causes the color filters to successively come into the optical path.

Figure 6:
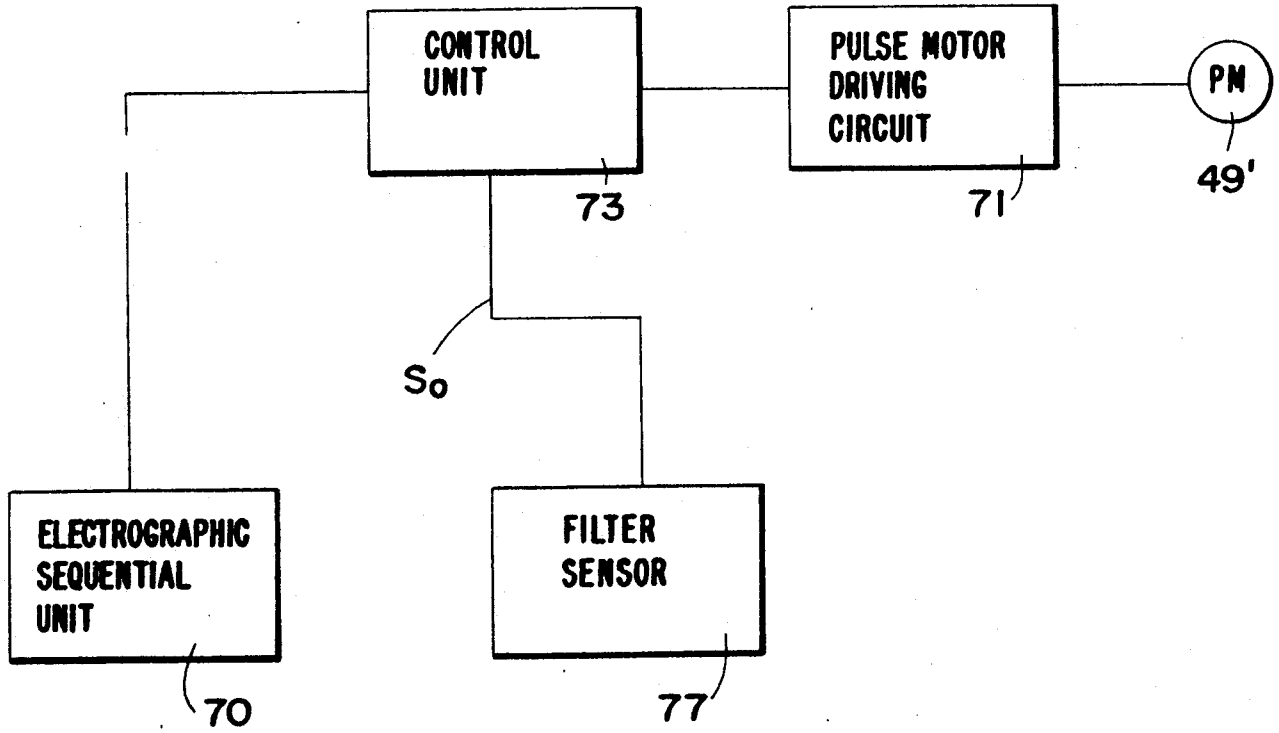
FIG. 6 is a block diagram for explaining the control of a pulse motor shown in FIG. 5.

With reference to FIG. 5, the endless belt 48 is rotated by the pulse motor 49'. The pulse motor 49' is controlled by a pulse motor driving circuit 71 (FIG. 6) connected thereto which is, in turn, controlled by a control unit 73 (FIG. 6). The control unit 73 is activated by a main switch (not shown) of the copying machine. A filter sensor (detector) 77 which corresponds to the insertion detecting microswitch 60 in the above-mentioned embodiment is located along the travel path of the first filter frame, e.g., the filter frame 34, so that the filter sensor 77 can be actuated by the filter frame 34 which occupies the operative position.

Figure 7:
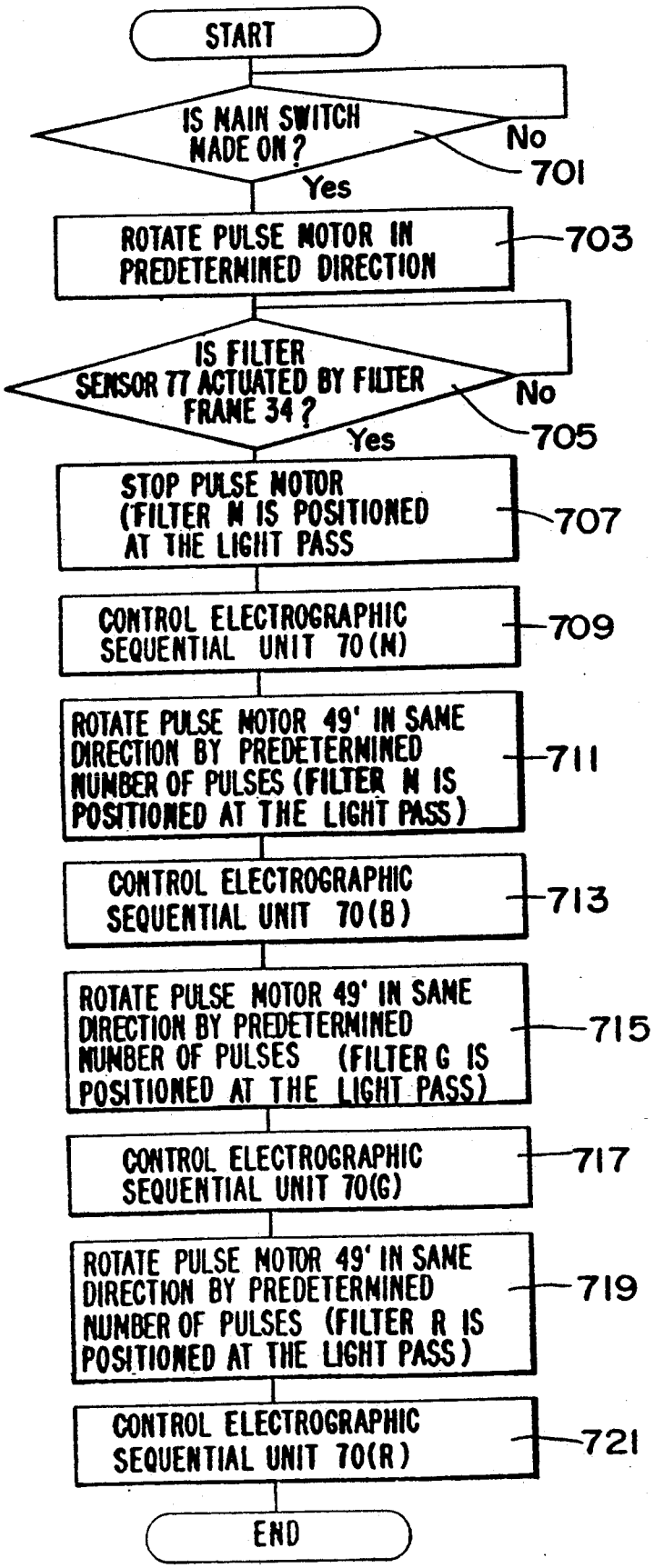
FIG. 7 is a flow chart showing the control steps of the control unit shown in FIG. 6; and, FIG. 8 is a schematic view showing a copying process of a known color copier.
Figure 8:
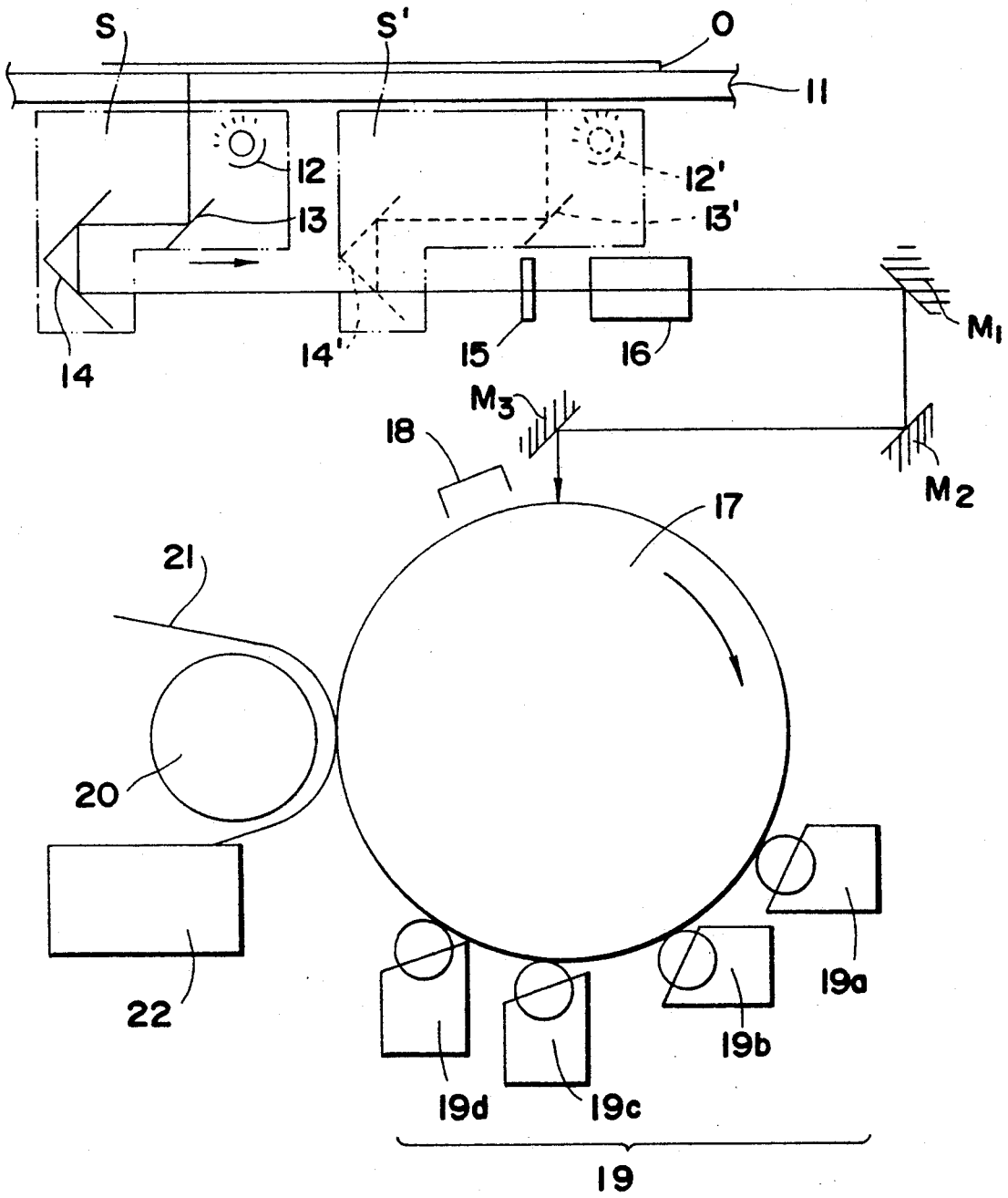
Fig. 8 PRIOR ART

With reference to FIG. 7 which shows a flow chart for the control of the pulse motor 49', when the main switch (not shown) of the copying machine is made ON at step 701, the pulse motor 49' (PM) is rotated in a predetermined direction, e.g., in the clockwise direction at step 703. As a result of the commencement of the rotation of the pulse motor PM, the filter frame 34 is first moved by the endless belt 48 due to the engagement between the projection 50 and the abutment 35. At step 705, when the filter sensor 77 is actuated by the filter frame 34 for the monochrome filter M, that is, when the filter frame 34 comes to the operative position, i.e., in the optical path of the imaging optical system, the pulse motor PM is stopped at step 707. At step 709, an electrographic sequential unit 70 which is connected to the control unit 73 is then controlled to carry out necessary operations including color separation, transfer of images and development of images, etc. After that, the pulse motor PM is rotated again in the same direction by a predetermined number of pulses, so that the second color filter 33 is brought into the operative position, at step 711. Similarly to step 709, the electrographic sequential unit 70 is controlled to complete color separation by the color filter B at step 713. After that, the operations from steps 711 and 713 are repeated for the filter frames 32 and 31 at steps 715 to 721.

Figure 4:
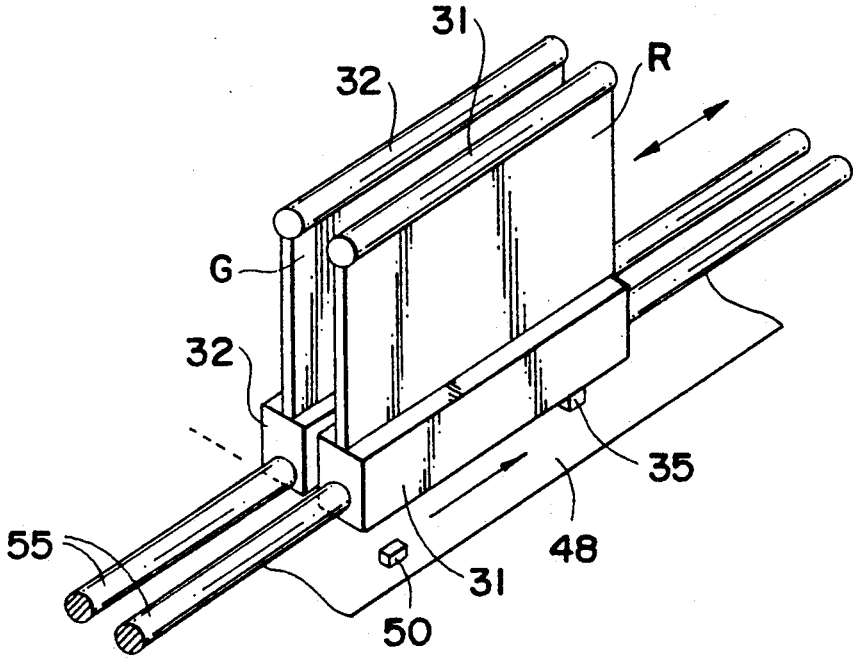
FIG. 4 is a perspective view of another linear guide mechanism for color filters.

FIG. 4 shows guide rods 55 for the linear movement of the filter frames 31–34. The guide rods 55 slidably extend through the associated filter frames 31–34, so that the filter frames can move along the guide rods 55. It should be appreciated that in this modified embodiment of the guide means of the filter frames, fewer components are necessary.

It should be noted that the arrangement of the color filters R, G, B and M and the kind of color are not limited to those of the illustrated embodiments mentioned above. For example, the color filters of yellow, magenta and cyanine can be located in this order.

I claim:

1. A color separating device in a color copying machine having a light source for illuminating an object, an imaging optical system for projecting an image of the illuminated object, a photoconductive body for receiving an image of the object formed by the imaging optical system, and a color separating device for separating colors of the image of the illuminated object, said color separating device comprising:

(a) a predetermined number of color filters corresponding to the colors to be separated, said color filters being substantially linearly movable, between a retracted position in which said color filters are retracted from an optical path of the imaging optical system and an operative position in which said color filters are located in the optical path;

(b) frames for carrying said color filters;

(c) means for guiding the linear movement of said color filters;

(d) means for continuously biasing said color filters toward said retracted position;

(e) an endless belt selectively engagable with said color filters for linearly moving said color filters;

(f) means for intermittently rotating said endless belt;

(g) means for establishing selective engagement of said color filters with said endless belt to successively bring color filters into said operative position against said biasing means; and (h) filter frames comprising means for carrying said color filters, wherein said establishing means comprises projections provided on said endless belt and a respective abutment provided on each of said filter frames, so that said projections of said endless belt can be selectively engaged by associated abutments of said filter frames to selectively bring said color filters into said operative position; and wherein said projections are placed so that when one of said projections is disengaged from an associated abutment of said filter frames, another projection of said endless belt is engaged by an associated abutment of another of said filter frames.

2. A color separating device according to claim 1, wherein said color filters are mounted to move between said retracted position and said operative position in a direction substantially perpendicular to the optical path.

3. A color separating device according to claim 1, wherein said filter frames are located parallel to each other.

4. A color separating device according to claim 1, wherein said color filters comprise at least red, green, and blue filters.

5. A color separating device according to claim 4, wherein said color filters further comprise at least one monochrome filter.

6. A color separating device according to claim 1, wherein said guiding means comprises upper and lower guide rails and side partition walls between the guide rails to separate the filter frames from one another, said filter frames being adapted to be moved on and along the upper and lower guide rails between the adjacent side partition walls.

7. A color separating device according to claim 1, wherein said guiding means comprises guide rods which extend through the filter frames, said color filters being adapted to slide on and along respective guide rods.

8. A color separating device according to claim 1, wherein said biasing means comprises spiral springs which are connected to associated filter frames.

9. A color separating device according to claim 8, wherein said biasing means comprises rotatable pulleys around which said spiral springs are wound.

10. A color separating device according to claim 1, further comprising means for detecting the filter frames which are brought into the operative position.

11. A color separating device according to claim 1, wherein said means for intermittently rotating the endless belt comprises a motor which is functionally connected to the endless belt.

12. A color separating device according to claim 1, wherein said means for intermittently rotating the endless belt comprises a pulse motor which is functionally connected to the endless belt.

13. A color separating device according to claim 1, wherein said establishing means is configured and arranged to seccessively bring said color filters into said operative position within one rotation of said endless belt.

14. A color separating device in a color copying machine having a light source for illuminating an object, an imaging optical system for projecting an image of the illuminated object, a photoconductive body for receiving an image of the object formed by the imaging optical system, and a color separating device for separating colors of the image of the illuminated object, said color separating device comprising:

(a) a predetermined number of color filters corresponding to the colors to be separated, said color filters being substantially linearly movable between a retracted position in which said color filters are retracted from an optical path of the imaging optical system and an operative position in which said color filters are located in the optical path;
(b) frames for carrying said color filters;
(c) means for guiding the linear movement of said color filters;
(d) means for continuously biasing said color filters toward said retracted position;
(e) an endless belt selectively engagable with said color filters for linearly moving said color filters;
(f) means for intermittently rotating said endless belt; and
(g) means for establishing selective engagement of said color filters with said endless belt to successively bring said color filters into said operative position against said biasing means, said establishing means comprising projections provided on said endless belt and a respective abutment provided on each of said filter frames, so that said projections of said endless belt can be selectively engaged by associated abutments of said filter frames to selectively bring said color filters into said operative position.

15. A color separating device according to claim 14, wherein said abutments provided on said filter frames are fixed against movement relative to said filter frames.

16. A color separating device according to claim 14, wherein said colors filters are mounted to move between said retracted position and said operative position in a direction substantially perpendicular to the optical path.

17. A color separating device according to claim 14, wherein said establishing means is configured and arranged to successively bring said color filters into said operative position within one rotation of said endless belt.

18. A color separating device for use in a color copying machine comprising:

(a) a plurality of color filters adapted for movement into an optical path;
(b) a plurality of abutments fixed relative to respective ones of said plurality of color filters;
(c) means for guiding said plurality of color filters into said optical path;
(d) means for selectively propelling said plurality of color filters into said optical path comprising projections for successively engaging said plurality of abutments; and
(e) means for moving said plurality of color filters out of said optical path.

19. A color separating device according to claim 18, wherein said means for guiding said plurality of color filters into said optical path guide said plurality of color filters substantially along repective linear paths in a substantially longitudinal direction into and out of said optical path.

20. A color separating device according to claim 19, wherein said means for guiding said plurality of color filters into said optical path mount said plurality of color filters laterally adjacent each other with respect to said linear path such that said plurality of abutments are substantially laterally positioned.

21. A color separating device according to claim 20, wherein said means for selectively propelling said plurality of color filters into said optical path comprises an endless belt, and wherein said projections are substantially laterally popsitioned for engagment with respective ones of said abutments of said plurality of color filters.

22. A color separating device according to claim 21, wherein said projections are further longitudinally spaced for successively engaging said abutments of said plurality of color filters.

23. A color separating device according to claim 22 wherein said projections are arranged on said endless belt such that upon disengagement of one of said projections with a respective one of said abutments of a respective one of said color filters, by movement of said endless belt in a given direction, a successive one of said projections engages a further one of said abutments.

24. A color separating device according to claim 22, further comprising means for intermittently rotating said endless belt, whereby said endless belt is momentarily stopped upon detection of one of said plurality of color filters within said optical path.

25. A color separating device according to claim 24, wherein said means for intermittently rotating said endless belt comprises a motor functionally connected to said endless belt.

26. A color separating device according to claim 24, wherein said means for intermittently rotating said endless belt comprises a pulse motor functionally connected to said endless belt.

27. A color separating device according to claim 18, wherein said plurality of color filters comprise a red filter, a green filter, and a blue filter.

28. A color separating device according to claim 27, wherein said plurality of color filters further comprises a monochrome filter.

29. A color separating device according to claim 18, wherein said means for moving said plurality of color filters out of said optical path comprises means for biasing each of said plurality of color filters against movement by said means for propelling.

30. A color separating device according to claim 29, wherein said means for biasing comprises a spring connected to each respective color filter.

31. A color separating device according to claim 18, further comprising means for detecting each of said plurality of color filters having been propelled into said optical path.

* * * * *

UNITED STATES PATENT AND TRADEMARK OFFICE

CERTIFICATE OF CORRECTION

PATENT NO. : 5,117,253

DATED : May 26, 1992

INVENTOR(S) : Minoru SUZUKI

It is certified that error appears in the above-indentified patent and that said Letters Patent is hereby corrected as shown below:

At column 7, line 44 (claim 13, line 3), change "seccessively" to ---successively---.

Signed and Sealed this

Eleventh Day of July, 1995

*Attest:*

Bruce Lehman

BRUCE LEHMAN

*Attesting Officer*

*Commissioner of Patents and Trademarks*